US007322123B2

(12) United States Patent
Tadano et al.

(10) Patent No.: US 7,322,123 B2
(45) Date of Patent: Jan. 29, 2008

(54) DRYING MACHINE

(75) Inventors: Masaya Tadano, Ota (JP); Tetsuya Masuda, Ota (JP); Takahiro Nakamura, Ota (JP); Masafumi Nishino, Kyoto (JP); Nobuhiro Asada, Kusatsu (JP); Mitsuru Naganawa, Joyo (JP)

(73) Assignees: Sanyo Electric Co., Ltd., Osaka (JP); Sanyo Electric Techno Clean Co., Ltd., Osaka (JP)

( * ) Notice: Subject to any disclaimer, the term of this patent is extended or adjusted under 35 U.S.C. 154(b) by 1 day.

(21) Appl. No.: 11/220,421

(22) Filed: Sep. 7, 2005

(65) Prior Publication Data

US 2006/0053651 A1 Mar. 16, 2006

(30) Foreign Application Priority Data

Sep. 7, 2004 (JP) ..... 2004-260003

(51) Int. Cl.
*F26B 21/06* (2006.01)

(52) U.S. Cl. ..... 34/77; 34/86

(58) Field of Classification Search ..... 34/514, 34/77, 86; 68/3 R
See application file for complete search history.

(56) References Cited

U.S. PATENT DOCUMENTS 4,471,537 A * 9/1984 Meda ..... 34/77
4,481,786 A * 11/1984 Bashark ..... 62/160

FOREIGN PATENT DOCUMENTS

| | | |
|---|---|---|
| JP | 10-89843 | 4/1998 |
| JP | 10-211383 | 8/1998 |
| JP | 11-99299 A | 4/1999 |
| JP | 11-244587 | 9/1999 |
| JP | 2000-107491 | 4/2000 |
| JP | 2000-157786 | 6/2000 |
| JP | 2003-265880 | 9/2003 |
| JP | 2004-236965 | 8/2004 |

* cited by examiner

*Primary Examiner*—S. Gravini
(74) *Attorney, Agent, or Firm*—McDermott Will & Emery LLP

(57) ABSTRACT

An object is to provide a drying machine which can accomplish delicate drying and reduce burdens on a matter to be dried during drying while securing a predetermined evaporation temperature in an evaporator. In summary, a dry cleaner equipped with a heat pump device comprises a water-cooling heat exchanger which removes heat from a refrigerant entering a capillary tube; and a control device which variably controls a discharged heat amount in the water-cooling heat exchanger and capacity of the compressor, wherein the control device has at least two kinds of drying modes including a usual drying mode and a delicate drying mode, and in the delicate drying mode, a temperature of air discharged into a storage chamber is set lower than in the usual drying mode to control the capacity of the compressor and to increase the discharged heat amount in the water-cooling heat exchanger.

8 Claims, 12 Drawing Sheets

PRESCRIBED VALUE 2: PROTECTION LEVEL AT WHICH COMPRESSOR NEEDS TO BE STOPPED (RISK DEGREE HIGHER THAN THAT OF PRESCRIBED VALUE 1)

PRESCRIBED VALUE 1: PROTECTION LEVEL AT WHICH COMPRESSOR DOES NOT NEED TO BE STOPPED BUT ITS CAPACITY NEEDS TO BE RESTRAINED

DRYING MACHINE

BACKGROUND OF THE INVENTION

The present invention relates to a drying machine which comprises a storage chamber to store a matter to be dried and which executes a drying operation for the matter to be dried in the storage chamber.

In such a drying machine, an electric heater or a gas burning heater has heretofore been used as a heat source. After heating outside air by the electric heater or the burning heater to produce high-temperature air, the air is blown into a storage chamber in which the matter to be dried is stored to thereby dry the matter to be dried in the storage chamber. Moreover, the high-temperature air in the storage chamber, which has dried the matter to be dried, is discharged to the outside.

However, in the drying machine using such an electric heater or gas burning heater, as low-temperature humid air outside the storage chamber is used for the high-temperature air sent into the storage chamber, a long time is required until the matter to be dried dries. Therefore, an energy consumption amount to dry the matter to be dried is increased, leading to a problem of increased energy costs such as an electric bill and a gas bill.

To solve the problem, a clothing drying machine has been developed which is constituted of a compressor, a heating coil, an expansion valve, and a cooling coil. A heat pump capable of circulating a heat exchange medium is utilized. The matter to be dried is dried by the high-temperature air heated by the heating coil. Moisture evaporated from the matter to be dried is condensed by the cooling coil, and removed, and a condensed water content is discarded (see, e.g., Japanese Patent Application Laid-Open No. 11-99299).

On the other hand, the matter to be dried in the clothing drying machine includes clothing made of materials whose quality is easily changed by heat. Such a matter to be dried is easily damaged by hot air during the drying operation, and it is therefore necessary to lower temperature of the hot air discharged into the storage chamber during the drying operation. Thus, in the conventional clothing drying machine using the heat pump, it is conceivable to restrict an operation frequency of the compressor to lower temperature of a high-temperature high-pressure refrigerant of a gas cooler (radiator) which exchanges heat with the air supplied into the storage chamber. However, in such a case, a pressure increases on a low-pressure side due to a pressure drop caused on a high-pressure side of a refrigerant circuit configured in the heat pump, thus leading to an increase in a refrigerant evaporation temperature of an evaporator. This causes a problem that it is not possible to sufficiently cool down the air from the storage chamber which exchanges heat with the evaporator, and the moisture evaporated from the matter to be dried cannot be condensed and removed. Particularly, in a dry cleaner using a petroleum-based solvent as a cleaning fluid, there are problems that the solvent cannot be sufficiently recovered, that a rate of recovering the solvent decreases, and that a running cost is increased due to an increase in an amount of added solvent.

SUMMARY OF THE INVENTION

A first aspect of the present invention is directed to a drying machine equipped with a storage chamber to store a matter to be dried, and a heat pump in which a refrigerant circuit is constituted of a compressor, a radiator, expansion means and an evaporator, a refrigerant discharged from the compressor being passed through the radiator, the expansion means and the evaporator, and air being circulated from the radiator to the evaporator through the storage chamber, whereby the matter to be dried is dried in the storage chamber, the drying machine comprising heat discharge means for removing heat from the refrigerant which enters the expansion means; and control means for variably controlling a discharged heat amount in the heat discharge means and capacity of the compressor, wherein the control means has at least two kinds of drying modes including a usual drying mode and a delicate drying mode, and in the delicate drying mode, a temperature of the air discharged into the storage chamber is set lower than in the usual drying mode to control the capacity of the compressor and to increase the discharged heat amount in the heat discharge means.

According to the first invention, while a high pressure can be adapted to a targeted value lower than a value during a normal operation, a decrease in cooling capacity due to a decrease in a refrigerant circulation amount can be compensated, thereby making it possible to lower the temperature of air discharged to the storage chamber while ensuring a predetermined cooling capacity in the evaporator. This allows delicate drying, and a reduction can be made in burdens on the matter to be dried during drying.

A second aspect of the present invention is directed to a drying machine equipped with a storage chamber to store a matter to be dried, and a heat pump in which a refrigerant circuit is constituted of a compressor, a radiator, expansion means and an evaporator, a refrigerant discharged from the compressor being passed through the radiator, the expansion means and the evaporator, air being circulated from the radiator to the evaporator through the storage chamber, whereby the matter to be dried is dried in the storage chamber, the drying machine comprising heat discharge means for removing heat from the refrigerant which enters the expansion means; and control means for variably controlling a discharged heat amount in the heat discharge means and a restriction amount in the expansion means, wherein the control means has at least two kinds of drying modes including a usual drying mode and a delicate drying mode, and in the delicate drying mode, a temperature of the air discharged into the storage chamber is set lower than in the usual drying mode to control the restriction amount in the expansion means and to increase the discharged heat amount in the heat discharge means.

According to the second invention, while a high pressure can be adapted to a targeted value lower than a value during a normal operation, a decrease in cooling capacity due to a decrease in a refrigerant circulation amount can be compensated, thereby making it possible to lower the temperature of air discharged to the storage chamber while ensuring a predetermined cooling capacity in the evaporator. This allows delicate drying, and a reduction can be made in burdens on the matter to be dried during drying.

A third aspect of the present invention is directed to the above drying machine, wherein the heat discharge means water-cools or air-cools the refrigerant which enters the expansion means, and the control means controls an amount of cooling water used for water-cooling or an amount of air used for air-cooling to control the discharged heat amount in the heat discharge means.

According to the third invention, in addition to the inventions described above, a discharged heat amount can be easily and accurately controlled.

A fourth aspect of the present invention is directed to the above drying machine, wherein the control means controls the discharged heat amount in the heat discharge means so as to maintain the temperature of the air passed through the evaporator at a prescribed value.

According to the fourth invention, in addition to the inventions described above, it is possible to secure a recovery efficiency of a washing liquid in the evaporator.

A fifth aspect of the present invention is directed to the above drying machine, wherein the control means executes a cooling-down mode in which the refrigerant discharged from the compressor is not passed to the radiator but is passed to the heat discharge means, the expansion means and the evaporator after termination of the drying mode in order to lower the temperature of the air discharged into the storage chamber, and the control means increases the discharged heat amount in the heat discharge means before the termination of the drying mode.

According to the fifth invention, in addition to the inventions described above, it is possible to effectively prevent a disadvantage that an abnormal increase is caused in a discharged refrigerant temperature of the compressor due to an insufficient discharged heat amount immediately after the cool-down mode is started.

This allows longer lives of devices constituting the heat pump, and also allows elimination of a disadvantage that the compressor stops protection.

DETAILED DESCRIPTION OF THE PREFERRED EMBODIMENT

The present invention has been attained to solve conventional technical problems, and provides a drying machine which achieves delicate drying and which can reduce burdens on a matter to be dried during drying while ensuring a predetermined evaporation temperature in an evaporator. Embodiments of the present invention will hereinafter be described in detail with reference to the drawings.

Figure 1:
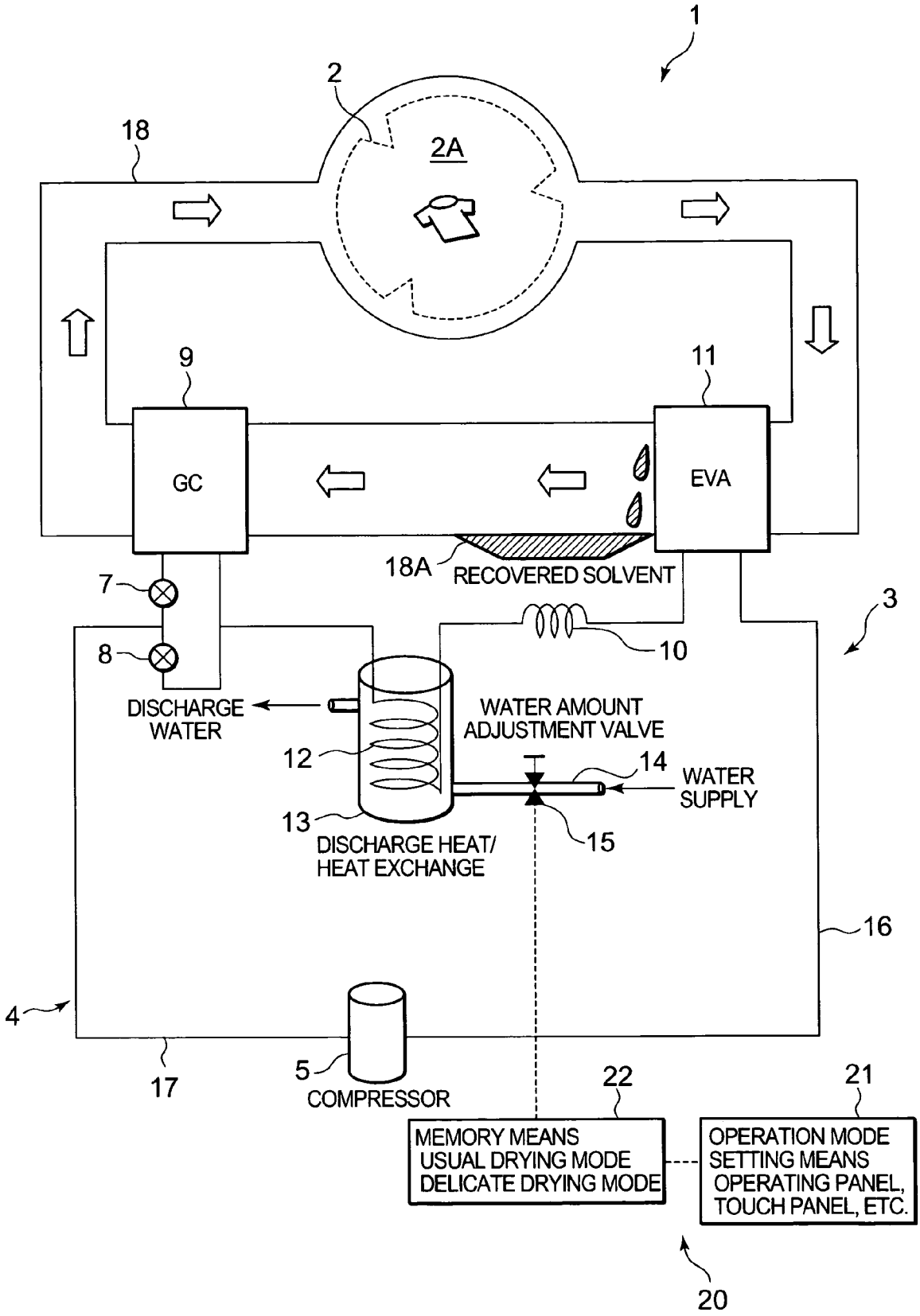
FIG. 1 is a schematic constitution diagram of a dry cleaner.
Figure 2:
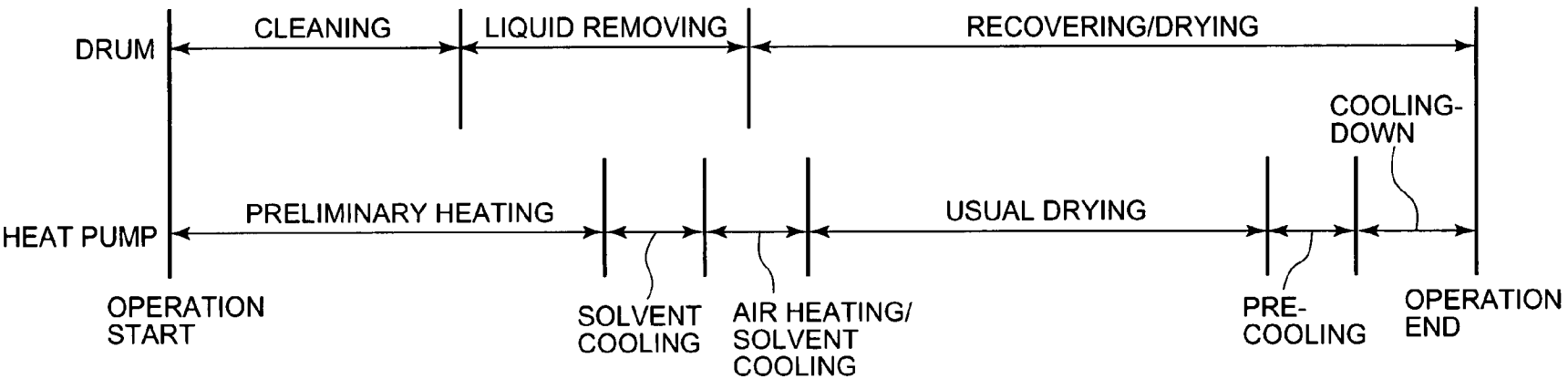
FIG. 2 is a diagram to explain an operation process of the dry cleaner of FIG. 1.

FIG. 1 shows a schematic constitution diagram of a dry cleaner 1 using, for example, a petroleum-based solvent as a cleaning fluid, in one embodiment of the drier to which the present invention is applied. In the drawing, 2 denotes a cylindrical drum including a large number of through holes formed in a peripheral wall, and clothing is washed with a washing liquid in a storage chamber 2A of the drum 2 and subsequent drying is also performed therein. This drum 2 is rotated by an unshown drum motor, for example, at a speed of 30 to 50 rpm.

Moreover, there is connected, to the drum 2, an unshown washing liquid circulation channel to supply/discharge the washing liquid into the storage chamber 2A, and the washing liquid circulation channel is connected to a washing liquid tank, a washing liquid pump, a filter, a washing liquid temperature control tank and the like which are not shown. When the washing liquid pump is operated, the washing liquid is supplied to the drum 2 from the washing liquid tank, and the washing liquid in the drum 2 passes through the filter via the washing liquid pump, and is fed to the washing liquid temperature control tank. Moreover, the washing liquid passed through the washing liquid temperature control tank returns to the washing liquid tank to repeat the circulation. It is to be noted that environment-friendly silicon (solvent) is used as the washing liquid in the present embodiment.

On the other hand, 3 denotes a heat pump device, and the heat pump device 3 comprises a refrigerant circuit 4. The refrigerant circuit 4 comprises a compressor 5, electromagnetic valves 7, 8, a gas cooler 9 which is a radiator, a capillary tube 10 which is expansion means, an evaporator 11 and the like. Here, the compressor 5 for use in the present embodiment is an inner intermediate pressure type multi-stage compression system rotary compressor. In an unshown sealed vessel thereof, there are disposed an electromotive element, a first rotary compression element (first stage) driven by this electromotive element, and a second rotary compression element (second stage). Moreover, a low-pressure refrigerant is introduced into the first rotary compression element of the compressor 5 from a refrigerant introduction tube 16, and a high-temperature high-pressure refrigerant compressed by the second rotary compression element is discharged to the outside of the compressor 5 from a refrigerant discharge tube 17.

Moreover, the refrigerant discharge tube 17 of the compressor 5 branches into two which are connected to the electromagnetic valves 7, 8. An outlet of the electromagnetic valve 7 is connected to the gas cooler 9, and a piping 12 extending out of the gas cooler 9 is connected to the capillary tube 10 through a water-cooling heat exchanger 13 as heat discharge means. An outlet of the electromagnetic valve 8 is connected to the piping 12 (inlet side of the water-cooling heat exchanger 13) extending out of the gas cooler 9.

Cooling water from a city water piping 14 is supplied to the water-cooling heat exchanger 13 to cool the refrigerant passed through the piping 12. It is to be noted that 15 denotes a water amount adjustment valve to control an amount of water passed to the water-cooling heat exchanger 13, and comprise, for example, a step motor valve or the like. On the other hand, the gas cooler 9 is disposed in a heat exchanging manner with respect to an air circulation path 18 described later.

Moreover, an outlet of the capillary tube 10 is connected to the evaporator 11, and an outlet of the evaporator 11 is connected to the compressor 5 on a suction side via the refrigerant introduction tube 16 of the compressor 5. The evaporator 11 is disposed in the heat exchanging manner with respect to the air circulation path 18.

Furthermore, in the dry cleaner 1 of the present embodiment, there is provided an unshown circuit, in addition to the refrigerant circuit 4, which is disposed for heat exchange of the high-temperature high-pressure refrigerant discharged from the compressor 5 in the washing liquid temperature control tank and an unshown heat radiating pipe and which is disposed for heat exchange of the low-pressure refrigerant from the capillary tube 10 in the washing liquid temperature control tank and an unshown evaporation pipe. Moreover, a predetermined amount of carbon dioxide ($CO_2$) is sealed as the refrigerant in the refrigerant circuit 4, and this amount enables a low pressure targeted during an operation in a delicate drying mode described later and is smaller than an ordinary sealing amount of refrigerant. Still further, an operation of the compressor 5 and the water amount adjustment valve 15 are controlled by a control device (control means) 20 comprising operation mode setting means 21, memory means 22 and the like.

On the other hand, the air circulation path 18 in the drawing circulates drying air in the drum 2. The air circulation path 18 constitutes an air path returning to the drum 2 successively through an unshown fan, the evaporator 11 and the gas cooler 9 from the drum 2. When the fan is operated, the air in the drum 2 is sucked, and reaches the evaporator 11. After heat exchange in the evaporator, the air successively exchanges the heat with the gas cooler 9, and is blown into the drum 2 to thereby repeat the circulation. It is to be noted that the air circulation path 18 extending out of the evaporator 11 is provided with a trap 18A, and this trap 18A communicates with the inside of the washing liquid tank.

It is to be noted that the control device 20 is control means which controls the dry cleaner 1. The control device 20 controls the operation of the drive motor, the operation of the washing liquid pump, the operation of the compressor 5, the opening/closing of the electromagnetic valves 7, 8, passed water amount adjustment of the water amount adjustment valve 15, and the like. Furthermore, the control device 20 controls an operation frequency of the compressor 5 based on a discharged refrigerant pressure and temperature of a case housing the respective devices so that a matter to be washed stored in the storage chamber 2A of the drum 2 will not change color and be damaged. The control device 20 further controls a passed water amount by the water amount adjustment valve 15 based on an inlet refrigerant temperature of the capillary tube 10 to achieve a predetermined temperature.

Next, an operation of the dry cleaner 1 of the present embodiment will be described with reference to FIGS. 2 to 9 in the above-described constitution. After starting the operation, the control device 20 of the dry cleaner 1 successively executes operation steps: a washing step—a dewatering step—a recovering/drying step, in accordance with a program for a predetermined time. Moreover, along with progresses of the respective operation steps, the heat pump device 3 is successively operated in the following modes: a preliminary heating (preheating) mode—a solvent cooling mode—an air heating/solvent cooling mode—a drying mode—(a pre-cooling mode)—a cooling-down mode. Particularly, in the present invention, the control device 20 has two kinds of drying modes as a drying mode: a usual drying mode, and the delicate drying mode in which temperature of the air discharged to the storage chamber 2A is lower than in the usual drying mode. Selection of these drying modes can be set by the operation mode setting means 21 described above.

(1) Washing Step

First, in the washing step, the control device 20 rotates (repeats forward/backward rotation) the drum 2 at a speed of 30 to 50 rpm, operates the washing liquid pump, and circulates the washing liquid in the drum 2 via the washing liquid circulation channel. The clothing put in the drum 2 is washed by the rotation of the drum 2 using the washing liquid. From the start of this washing step, the control device 20 brings the heat pump device 3 into a preliminary heating mode. In this preliminary heating mode, the control device 20 closes the electromagnetic valves 7, 8 of the refrigerant circuit 4, and opens an unshown electromagnetic valve which brings the refrigerant from the compressor 5 as described above to the washing liquid temperature control tank.

Moreover, the compressor 5 of the refrigerant circuit 4 is operated. When the compressor 5 is operated, a high-temperature high-pressure carbon dioxide refrigerant compressed into a supercritical state is discharged to the refrigerant discharge tube 17 from the compressor 5 on a discharge side, and flows into the unshown heat radiating pipe disposed in the washing liquid temperature control tank through the unshown electromagnetic valve. Then, the high-temperature refrigerant radiates heat, and heats the washing liquid circulated in the washing liquid temperature control tank. The refrigerant which has radiated the heat in the heat radiating pipe flows into the capillary tube 10 still in the supercritical state, and is liquefied in a pressure reducing process.

Next, the refrigerant flows into the unshown evaporation pipe disposed in the washing liquid temperature control tank, and it is evaporated therein and absorbs the heat from the washing liquid temperature control tank to thereby cool the tank. Thereafter, the refrigerant is sucked into the compressor 5 on the suction side. The temperature of the compressor 5 rises by this operation. In the washing liquid temperature control tank, the heating by the heat radiating pipe and the cooling by the evaporation pipe are simultaneously performed. The temperature of the washing liquid circulated in the washing liquid temperature control tank gradually rises by the heat corresponding to the power projected in the compressor 5 of the refrigerant circuit 4. Accordingly, a washing effect of the clothing in the drum 2 is enhanced. Especially, the temperature of the washing liquid is raised, for example, early in the morning in winter, and a washing capacity can be quickly secured.

(2) Dewatering Step

When ending the washing step of the program for a predetermined time, the control device 20 next shifts to a dewatering step. In this dewatering step, the washing liquid circulation channel is switched to a path which bypasses the drum 2 to thereby operate the washing liquid pump. Moreover, an unshown liquid discharge valve is opened to discharge the washing liquid in the drum 2. Moreover, the drum 2 is rotated (rotated forwards) at a high speed of, for example, 600 to 700 rpm, and the liquid is removed from the clothing.

After shifting to the dewatering step, if the temperature of the washing liquid temperature control tank has risen to a predetermined temperature in the preliminary heating mode, the control device 20 brings the heat pump device 3 into a solvent cooling mode. In this solvent cooling mode, the control device 20 closes an electromagnetic valve of the refrigerant circuit 4 directed to the washing liquid temperature control tank and the electromagnetic valve 7, and opens the electromagnetic valve 8. The control device also opens the water amount adjustment valve 15 to pass water from the city water piping 14 to the water-cooling heat exchanger 13.

Moreover, when the compressor 5 of the refrigerant circuit 4 is operated, a high-temperature high-pressure carbon dioxide refrigerant compressed into the supercritical state is discharged to the refrigerant discharge tube 17 from the compressor 5 on the discharge side, and flows into the piping 12 via the electromagnetic valve 8. The refrigerant is cooled by city water distributed in the water-cooling heat exchanger 13 while passing through the piping 12, flows into the capillary tube 10 still in the supercritical state, and is liquefied in a pressure reducing process.

Next, the refrigerant flows into the evaporation pipe provided in the heat exchanging manner with respect to the washing liquid temperature control tank. In the pipe, the refrigerant is evaporated, and absorbs the heat from the washing liquid temperature control tank to thereby cool the tank. It is to be noted that the unshown electromagnetic valves which are provided upstream of the evaporation pipe provided in the heat exchanging manner with respect to the washing liquid temperature control tank and of the evaporator 11 are switched to control the refrigerant running from the capillary tube 10 so that the refrigerant flows into the evaporation pipe or into the evaporator 11.

Thereafter, the refrigerant discharged from the evaporation pipe is sucked into the compressor 5 on the suction side. When the washing liquid temperature control tank is at a predetermined temperature or more, the control device 20 controls the operation frequency of the compressor 5 in such a manner as to set a refrigerant entering the evaporation pipe at the predetermined temperature. When the washing liquid temperature control tank reaches the predetermined temperature or less, the operation frequency of the compressor 5 is lowered. When the temperature of the washing liquid temperature control tank further drops, the compressor 5 is stopped. The amount of water passed into the water-cooling heat exchanger 13 is controlled in such a manner as to set the refrigerant at the inlet of the capillary tube 10 at the predetermined temperature by the water amount adjustment valve 15.

Moreover, the control device 20 brings the heat pump device 3 into an air heating/solvent cooling mode immediately (e.g., several minutes) before ending the dewatering step. In this air heating/solvent cooling mode, the control device 20 closes the electromagnetic valve of the refrigerant circuit 4 directed to the washing liquid temperature control tank and the electromagnetic valve 8, and opens the electromagnetic valve 7. The controller also opens the water amount adjustment valve 15 to pass water from the city water piping 14 to the water-cooling heat exchanger 13.

Moreover, when the compressor 5 of the refrigerant circuit 4 is operated, a high-temperature high-pressure carbon dioxide refrigerant compressed into the supercritical state is discharged to the refrigerant discharge tube 17 from the compressor 5 on the discharge side, and flows into the gas cooler 9 via the electromagnetic valve 7. The refrigerant radiates the heat in the pipe, and heats the air in the air circulation path 18 around the gas cooler 9.

The refrigerant is cooled there, emanates from the gas cooler 9 while keeping the supercritical state, and flows into the piping 12. In the piping 12, the refrigerant exchanges the heat with the water-cooling heat exchanger 13, and further radiates heat. Then, the refrigerant is further cooled down, comes out from the piping 12 still in the supercritical state, flows into the capillary tube 10, and is liquefied in the pressure reducing process. Next, the refrigerant flows into the evaporator 11, evaporates there, and absorbs the heat from the air in air circulation path 18 to thereby cool the same. Thereafter, the refrigerant is sucked into the compressor 5 on the suction side via the refrigerant introduction tube 16. Furthermore, the amount of water passed into the water-cooling heat exchangers 13 is controlled by the water amount adjustment valve 15 in such a manner as to set the refrigerant at the inlet of the capillary tube 10 at a predetermined temperature. The dewatering step is executed by the program for a predetermined time, and ends midway in the air heating/solvent cooling mode.

(3) Recovering/Drying Step

When the dewatering step ends, the control device 20 next shifts to a recovering/drying step. In this recovering/drying step, the control device 20 operates the unshown fan, and further rotates the drum 2. When the fan is operated, the air in the air circulation path 18 is successively sent to the gas cooler 9 through the evaporator 11 as described above. Since the high-temperature high-pressure refrigerant of the refrigerant circuit 4 is circulated in the gas cooler 9 as described above, the air exchanges the heat therein and is thus heated. After the temperature thereof rises, the refrigerant is blown into the drum 2. The washing liquid is evaporated from the clothing in the drum 2 by this high-temperature air.

The air which has evaporated the washing liquid in the drum 2 is sucked from the drum 2 by the fan, and sent into the evaporator 11 to repeat this circulation. Moreover, the control device 20 brings the heat pump device 3 into the drying mode. Here, one of the usual drying mode and the delicate drying mode can be selected for the drying mode of the heat pump device 3 as described above, wherein the temperature of the air discharged to the storage chamber 2A can be set at, for example, +90° C. in the usual drying mode, while it can be set at +50° C. in the delicate drying mode. It is to be noted that the control device 20 once reduces the amount of water passed into the water-cooling heat exchanger 13 by the water amount adjustment valve 15 before shifting to the usual drying mode from the air heating/solvent cooling mode. Alternatively, the water passing is stopped to promote temperature rise of the circulating air in the air circulation path 18 as described later.

Moreover, the control device 20 closes the electromagnetic valve of the refrigerant circuit 4 directed to the washing liquid temperature control tank and the electromagnetic valve 8, and opens the electromagnetic valve 7. The controller also opens the water amount adjustment valve 15 to pass the water into the water-cooling heat exchangers 13 from the city water piping 14 as described above.

Moreover, when the compressor 5 of the refrigerant circuit 4 is operated, the high-temperature high-pressure carbon dioxide refrigerant compressed into the supercritical state is discharged to the refrigerant discharge tube 17 from the compressor 5 on the discharge side, and flows into the gas cooler 9 via the electromagnetic valve 7. The refrigerant radiates heat therein, and heats the air circulated in the air circulation path 18 around the gas cooler 9. Moreover, the heated air is discharged into the drum 2 to dry the clothing as described above.

On the other hand, the refrigerant is cooled there, emanates from the gas cooler 9 while keeping the supercritical state, flows into the piping 12, and is cooled by the water in the water-cooling heat exchanger 13 to thereby lower the temperature. It is to be noted that a description will be given later to details of control on a discharged heat amount in the water-cooling heat exchanger 13. The refrigerant flows into the capillary tube 10, and is liquefied in the pressure reducing process. Next, the refrigerant flows into the evaporator 11, evaporates there, absorbs the heat from the air circulating in the air circulation path 18 around the evaporator 11, and cools the air. The washing liquid evaporated in the air by the cooling is condensed on a surface of the evaporator 11. Moreover, the washing liquid liquefied on the surface of the evaporator 11 is recovered into the washing liquid tank from the trap 18A. The clothing in the drum 2 is efficiently dried by the heating of the clothing and the recovering of the washing liquid. Then, the refrigerant is sucked into the compressor 5 on the suction side.

Figure 3:
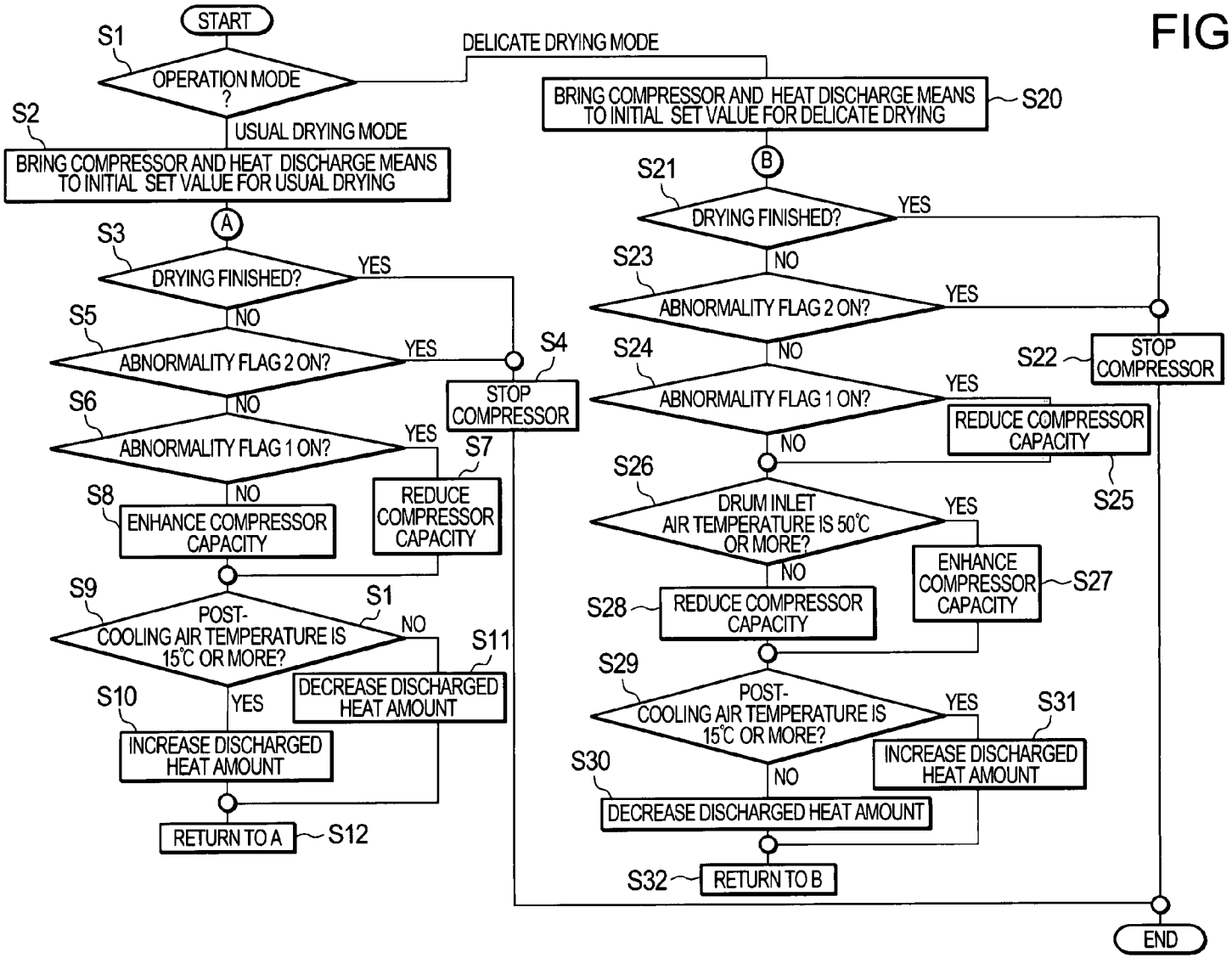
FIG. 3 is a flowchart for control of a compressor frequency and a discharged heat amount during drying by the dry cleaner of FIG. 1.
Figure 4:
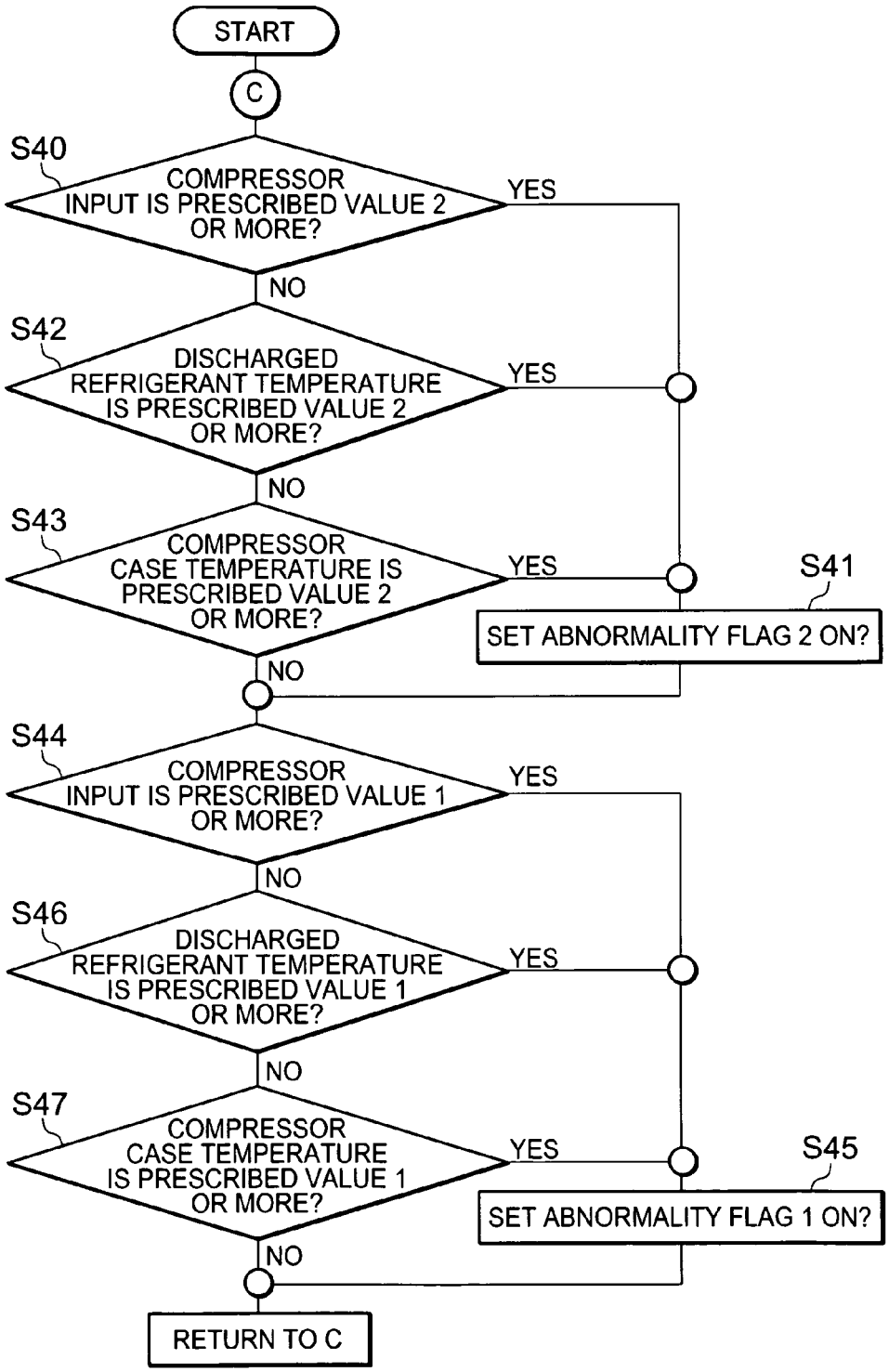
FIG. 4 is a flowchart showing fulfillment of abnormality flags in FIG. 3.

Here, the detailed control in the drying mode described above will be described referring to FIGS. 3 to 6. FIG. 3 is a flowchart for the compressor frequency and the discharged heat amount during drying, and FIG. 4 is a flowchart showing fulfillment of abnormality flags in FIG. 3.

The control device 20 initially judges in step S1 whether the operation mode preset by the operation mode setting means is the usual drying mode or the delicate drying mode. When the set operation mode is the usual drying mode, the control device 20 proceeds to step S2, and brings the compressor 5 to an initial set value for usual drying. That is, in this usual drying mode, a target inlet air temperature of the drum 2 is compared with a current detected temperature, and then the frequency of the compressor 5 changed at a time is made higher and an open degree of the water amount adjustment valve 15 changed at a time is made larger. At the start of drying, since the clothing as the matter to be dried contains much solvent, an outlet air temperature of the drum 2 is low due to evaporation latent heat caused by the solvent, and there is no extra need to discharge heat in the water-cooling heat exchanger 13, so that the water amount adjustment valve 15 has a predetermined open degree which keeps a lower amount of passed water at the beginning. Subsequently, the compressor 5 is controlled to bring the inlet air temperature of the drum 2 to, for example, +90° C.

Then, the control device 20 proceeds to step S3 via A in FIG. 3, and judges whether or not the drying of the matter to be dried in the storage chamber 2A has been completed. When the drying has been completed, the control device 20 proceeds to step S4, stops the operation of the compressor 5, and terminates the drying mode. On the other hand, when the drying has not been completed, the control device 20 proceeds to step S5 and judges whether or not an abnormality flag 2 is fulfilled.

Here, an operation to reach the fulfillment of the abnormality flag 2 and fulfillment of an abnormality flag 1 described later in FIG. 3 will be explained referring to FIG. 4. First, the control device 20 proceeds to step S40 via C in FIG. 4 in an operation to observe the fulfillment of the respective abnormality flags, and judges whether or not an input of the compressor 5 has reached a protection level (hereinafter, prescribed value 2) at which the frequency of the compressor 5 needs to stop the compressor 5. When it has reached the prescribed value 2 in step S40, the control device 20 proceeds to step S41 considering that the abnormality flag 2 is fulfilled. On the other hand, when it has not reached the prescribed value 2 in step S40, the control device 20 proceeds to step S42 and judges whether or not a temperature of the refrigerant discharged from the compressor 5 has reached the prescribed value 2. When it has reached the prescribed value 2 in step S42, the control device 20 proceeds to step S41 considering that the abnormality flag 2 is fulfilled. On the other hand, when it has not reached the prescribed value 2 in step S42, the control device 20 proceeds to step S43 and judges whether or not a case temperature of the compressor 5 has reached the prescribed value 2. When it has reached the prescribed value 2 in step S43, the control device 20 proceeds to step S41 considering that the abnormality flag 2 is fulfilled.

Next, when the case temperature has not reached the prescribed value 2 in step S43, the control device 20 proceeds to step S44 after the abnormality flag 2 is fulfilled in step S41. In step S44, the control device 20 judges whether or not the input of the compressor 5 has reached a protection level (hereinafter, prescribed value 1) at which the compressor 5 does not need to be stopped but capacity thereof needs to be restrained. When it has reached the prescribed value 1 in step S44, the control device 20 proceeds to step S45 considering that the abnormality flag 1 is fulfilled. On the other hand, when it has not reached the prescribed value 1 in step S44, the control device 20 proceeds to step S46 and judges whether or not the temperature of the refrigerant discharged from the compressor 5 has reached the prescribed value 1. When it has reached the prescribed value 1 in step S46, the control device 20 proceeds to step S45 considering that the abnormality flag 1 is fulfilled. On the other hand, when it has not reached the prescribed value 1 in step S46, the control device 20 proceeds to step S47 and judges whether or not the case temperature of the compressor 5 has reached the prescribed value 1. When it has reached the prescribed value 1 in step S47, the control device 20 proceeds to step S45 considering that the abnormality flag 1 is fulfilled.

When the case temperature has not reached the prescribed value 1 in step S47 and after the abnormality flag 1 is fulfilled in step S45, the control device 20 again returns to C, and then the control device 20 again repeats the operation to observe the fulfillment of the respective abnormality flags.

On the other hand, when the abnormality flag 2 as described above is fulfilled in step S5, the control device 20 proceeds to step S4, stops the operation of the compressor 5, and terminates the drying mode. On the other hand, when the abnormality flag 2 is not fulfilled, the control device 20 proceeds to step S6 and judges whether or not the abnormality flag 1 as described above has been fulfilled.

When the abnormality flag 1 is fulfilled in step S6, the control device 20 proceeds to step S7, and decreases the capacity, that is, the frequency of the compressor 5, thus proceeding to step S9. On the other hand, when the abnormality flag 1 is not fulfilled in step S6, the control device 20 proceeds to step S8, and increases the capacity, that is, the frequency of the compressor 5, thus proceeding to step S9.

Subsequently, the control device 20 judges in step S9 whether or not the air temperature (hereinafter, post-cooling air temperature) of the air circulation path 18 after cooled down in the evaporator 11 is a predetermined temperature, for example, +15° C. or more. When the post-cooling air temperature is +15° C. or more, the control device 20 proceeds to step S10 considering that the air temperature in the storage chamber 2A has not sufficiently been dropped, and increases the open degree of the water amount adjustment valve 15 in order to increase the discharged heat amount of the water-cooling heat exchanger 13. When the post-cooling air temperature is not +15° C. or more in step S9, the control device 20 proceeds to step S11 considering that the air temperature in the storage chamber 2A has sufficiently been dropped, and reduces the open degree of the water amount adjustment valve 15 in order to decrease the discharged heat amount of the water-cooling heat exchanger 13.

In this way, especially, in order to achieve cooling capacity required when the circulating air in the air circulation path 18 contains heat, for example, at the end of drying, the discharged heat amount is controlled to bring the post-cooling air temperature to +15° C. or more, so that the waste heat confined in the circulating air can be efficiently eliminated.

Subsequently, the control device 20 proceeds from step S10 and step S11 to step S12 and again returns to A to repeat the control as described above, until operation time for the drying mode is terminated. Thus, in accordance with the usual drying mode, an inlet refrigerant temperature of the gas cooler 9 can be maintained at about +100° C. and an inlet refrigerant temperature of the evaporator 11 can be maintained at about +5° C. Consequently, the temperature of the air discharged into the storage chamber 2A (drum inlet air temperature) can be maintained at about +90° C. and the post-cooling air temperature can be maintained at about +15° C., thereby achieving the efficient drying operation.

Figure 5:
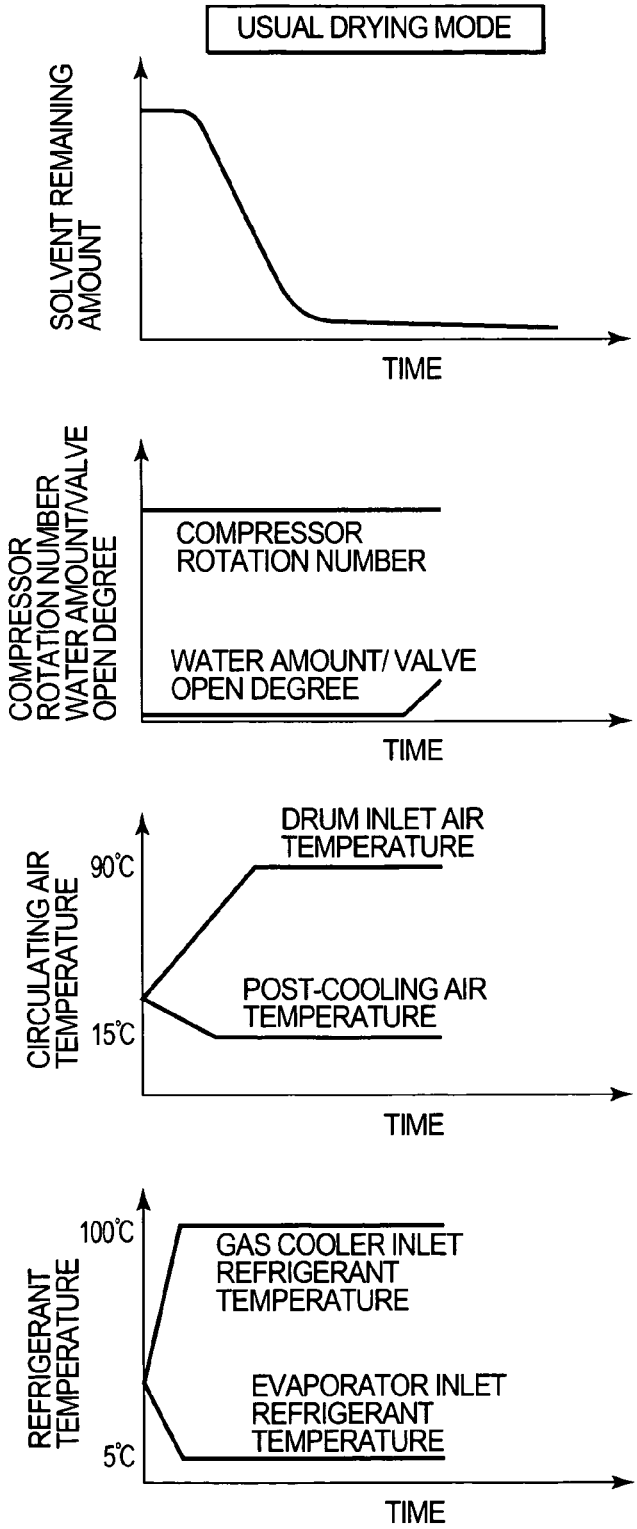
FIG. 5 is a diagram showing changes in temperature and the like over time in a usual drying mode.
Figure 6:
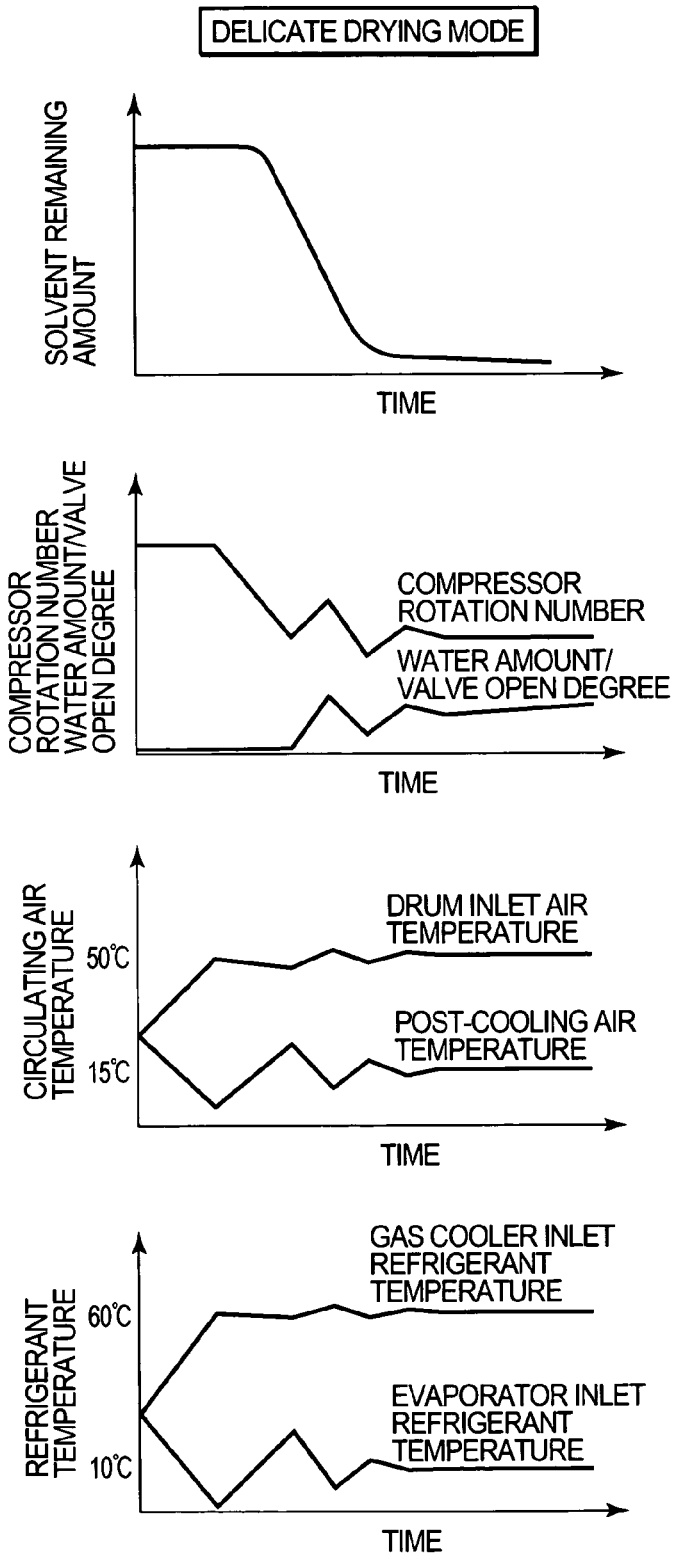
FIG. 6 is a diagram showing changes in temperature and the like over time in a delicate drying mode.

It is to be noted that in FIG. 5, there are shown, from top to bottom, a diagram representing a solvent remaining amount relative to time in the usual drying mode, a diagram representing a rotation number of the compressor 5 and the open degree of the water amount adjustment valve 15 relative to time, a diagram representing the drum inlet air temperature and the post-cooling air temperature relative to time, and a diagram representing the inlet refrigerant temperature of the gas cooler 9 and the inlet refrigerant temperature of the evaporator 11 relative to time.

On the other hand, when the set operation mode is the delicate drying mode in step S1, the control device 20 proceeds to step S20, and brings the compressor 5 to an initial set value for delicate drying. That is, in this delicate drying mode, the targeted drum inlet air temperature is compared with a current detected temperature, and then the frequency of the compressor 5 changed at a time is made lower than in the usual drying mode and the open degree of the water amount adjustment valve 15 changed at a time is made smaller than in the usual drying mode. At the start of drying, since the clothing as the matter to be dried contains much solvent, the outlet air temperature of the drum 2 is low due to evaporation latent heat caused by the solvent, and there is no extra need to discharge heat in the water-cooling heat exchanger 13, so that the water amount adjustment valve 15 has the predetermined open degree which keeps a lower amount of passed water at the beginning.

Subsequently, the control device 20 proceeds to step S21 via B in FIG. 3, and judges whether or not the drying of the clothing in the storage chamber 2A has been completed. When the drying has been completed, the control device 20 proceeds to step S22, stops the operation of the compressor 5, and terminates the drying mode. On the other hand, when the drying has not been completed, the control device 20 proceeds to step S23 and judges whether or not the abnormality flag 2 is fulfilled.

When the abnormality flag 2 is fulfilled in step S23, the control device 20 proceeds to step S22, stops the operation of the compressor 5, and terminates the drying mode. On the other hand, when the abnormality flag 2 is not fulfilled, the control device 20 proceeds to step S24 and judges whether or not the abnormality flag 1 is fulfilled.

When the abnormality flag 1 is fulfilled in step S24, the control device 20 proceeds to step S25, and decreases the capacity, that is, the frequency of the compressor 5, thus proceeding to step S26. On the other hand, when the abnormality flag 1 is not fulfilled in step S24, the control device 20 proceeds to step S26 and judges whether or not the drum inlet air temperature is +50° C. or more.

When the drum inlet air temperature is +50° C. or less in step S26, the control device 20 proceeds to step S27 considering that the air temperature in the drum 2 (the storage chamber 2A) has not reached +50° C., and increases the capacity, that is, the frequency of the compressor 5, thus proceeding to step S29. On the other hand, when the drum inlet air temperature is +50° C. or more in step S26, the control device 20 proceeds to step S28 considering that the air temperature in the drum 2 (the storage chamber 2A) has reached +50° C., and decreases the capacity, that is, the frequency of the compressor 5, thus proceeding to step S29.

Subsequently, the control device 20 judges in step S29 whether or not the air temperature, that is, the post-cooling air temperature of the air circulation path 18 after cooled down in the evaporator 11 is the predetermined temperature, for example, +15° C. or more. When the post-cooling air temperature is +15° C. or more, the control device 20 proceeds to step S31 considering that the air temperature in the storage chamber 2A has not sufficiently been dropped, and increases the open degree of the water amount adjustment valve 15 in order to increase an discharged heat amount of the water-cooling heat exchanger 13. Thus, the discharged heat amount in the water-cooling heat exchanger 13 increases to allow much supercooling, so that density of refrigerant before expanded in the capillary tube 10 can be high. Consequently, a high-pressure side is maintained at a predetermined value while a low-pressure side is reduced, and the evaporation temperature in the evaporator 11 can be lowered.

On the other hand, when the post-cooling air temperature is not +15° C. or more in step S29, the control device 20 proceeds to step S30 considering that the air temperature in the storage chamber 2A has sufficiently been dropped, and reduces the open degree of the water amount adjustment valve 15 in order to decrease the discharged heat amount of the water-cooling heat exchanger 13.

Subsequently, the control device 20 proceeds from step S30 and step S31 to step S32 and again returns to B to repeat the control as described above, until the operation time for the drying mode is terminated. Thus, in accordance with the delicate drying mode, the inlet refrigerant temperature of the gas cooler 9 can be maintained at about +60° C. and the inlet refrigerant temperature of the evaporator 11 can be maintained at about +10° C. Consequently, the drum inlet air temperature can be maintained at about +50° C. and the post-cooling air temperature can be maintained at about +15° C., thereby achieving the efficient drying operation at a relatively low temperature. It is to be noted that in FIG. 6, there are shown, from top to bottom, a diagram representing the solvent remaining amount relative to time in the delicate drying mode, a diagram representing the rotation number of the compressor 5 and the open degree of the water amount adjustment valve 15 relative to time, a diagram representing the drum inlet air temperature and the post-cooling air temperature relative to time, and a diagram representing the inlet refrigerant temperature of the gas cooler 9 and the inlet refrigerant temperature of the evaporator 11 relative to time.

As described above in detail, in the present embodiment, one of the usual drying mode and the delicate drying mode can be selected as the drying mode. Therefore, the clothing can be efficiently dried in a short time in the usual drying mode, while the clothing can be dried at a lower temperature in the delicate drying mode, so that the clothing made of a material susceptible to heat can also be dried.

Especially, the passed water amount in the water-cooling heat exchanger 13 is made larger by the water amount adjustment valve 15 in the delicate drying mode than in the usual drying mode to allow an increase in the discharged heat amount, and the high-pressure side of the refrigerant circuit 4 can be maintained at a predetermined high value without being dropped to prevent an increase on the low-pressure side. Particularly in the present embodiment, the passed water amount is controlled by the water amount adjustment valve 15 to maintain the temperature of the air passed through the evaporator 11 at a prescribed value, for example, +15° C. in the delicate drying mode. Therefore, it is possible to ensure the predetermined evaporation temperature in the evaporator 11, that is, a temperature of about +15° C. which is required to recover the solvent as the washing liquid used in the present embodiment, thereby ensuring that the solvent can be recovered. Further, the temperature of the air discharged into the storage chamber 2A can be lowered, and the delicate drying can be accomplished.

It is to be noted that in the present embodiment, the discharged heat amount and the capacity of the compressor 5 are controlled in the delicate drying mode to maintain the drum inlet air temperature at about +50° C. and the post-cooling air temperature at about +15° C., thereby achieving the efficient delicate drying. However, in addition to this, the delicate drying mode can be implemented in a configuration as shown in FIG. 7.

Figure 7:
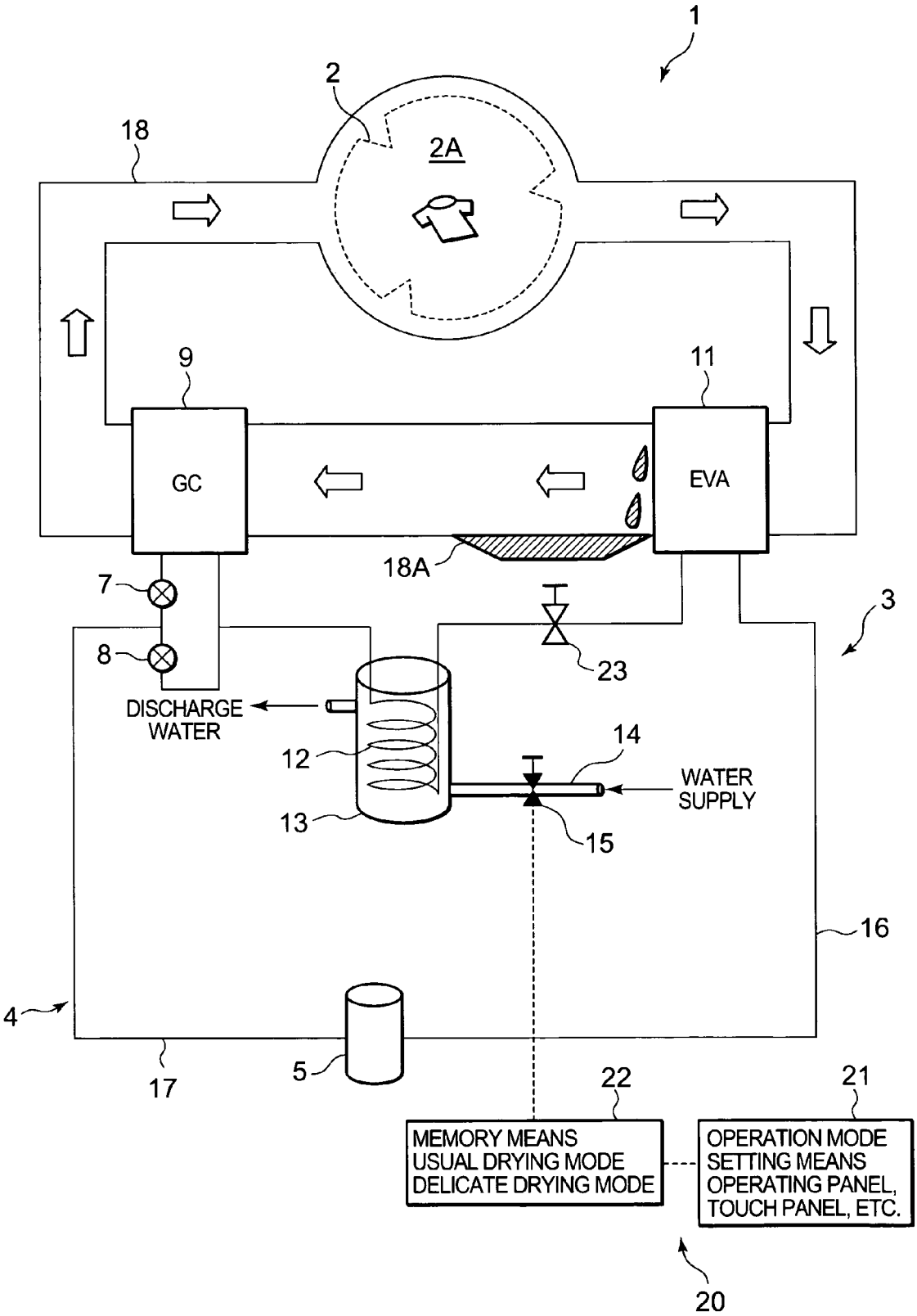
FIG. 7 is a schematic constitution diagram of the dry cleaner according to another embodiment.

That is, in the configuration of FIG. 7, the capillary tube 10 in the configuration described above is replaced with an electronic expansion valve 23 which can be opened/closed, and the compressor 5 is replaced with a constant-speed compressor. When the drying mode is the usual drying mode, an operation is performed at a minimum restriction amount of the expansion valve 23 to the extent that the constant-speed compressor is not overloaded. Contrarily, in the delicate drying mode, the discharged heat amount is controlled by the water amount adjustment valve 15, and the restriction amount of the expansion valve 23 is variably controlled instead of changing the operation frequency of the compressor 5 to control the drum inlet air temperature, thereby controlling the drum inlet air temperature.

Thus, the discharged heat amount can be increased as compared with that in the usual drying mode owing to the variable control of the restriction amount by the expansion valve 23 and the control of the passed water amount by the water amount adjustment valve, and the high-pressure side of the refrigerant circuit 4 can be maintained at the predetermined high value without being dropped to prevent an increase on the low-pressure side. Therefore, again in this case, the passed water amount is controlled by the water amount adjustment valve 15 to maintain the temperature of the air passed through the evaporator 11 at the prescribed value, for example, +15° C. in the delicate drying mode, so that it is possible to ensure the predetermined evaporation temperature in the evaporator 11, that is, a temperature of about +15° C. which is required to recover the solvent as the washing liquid used in the present embodiment, thereby ensuring that the solvent can be recovered. Further, the temperature of the air discharged into the storage chamber 2A can be lowered, and the delicate drying can be accomplished.

After one drying mode out of the usual drying mode and the delicate drying mode as described above in detail has been performed by the program for a predetermined time, the control device 20 brings the heat pump device 3 into the pre-cooling mode immediately before the end of the drying mode. In the pre-cooling mode, the control device 20 operates the fan and the compressor 5 continuously from the preceding drying mode, and fully opens the water amount adjustment valve 15 to pass water from the city water piping 14 to the water-cooling heat exchangers 13.

Figure 8:
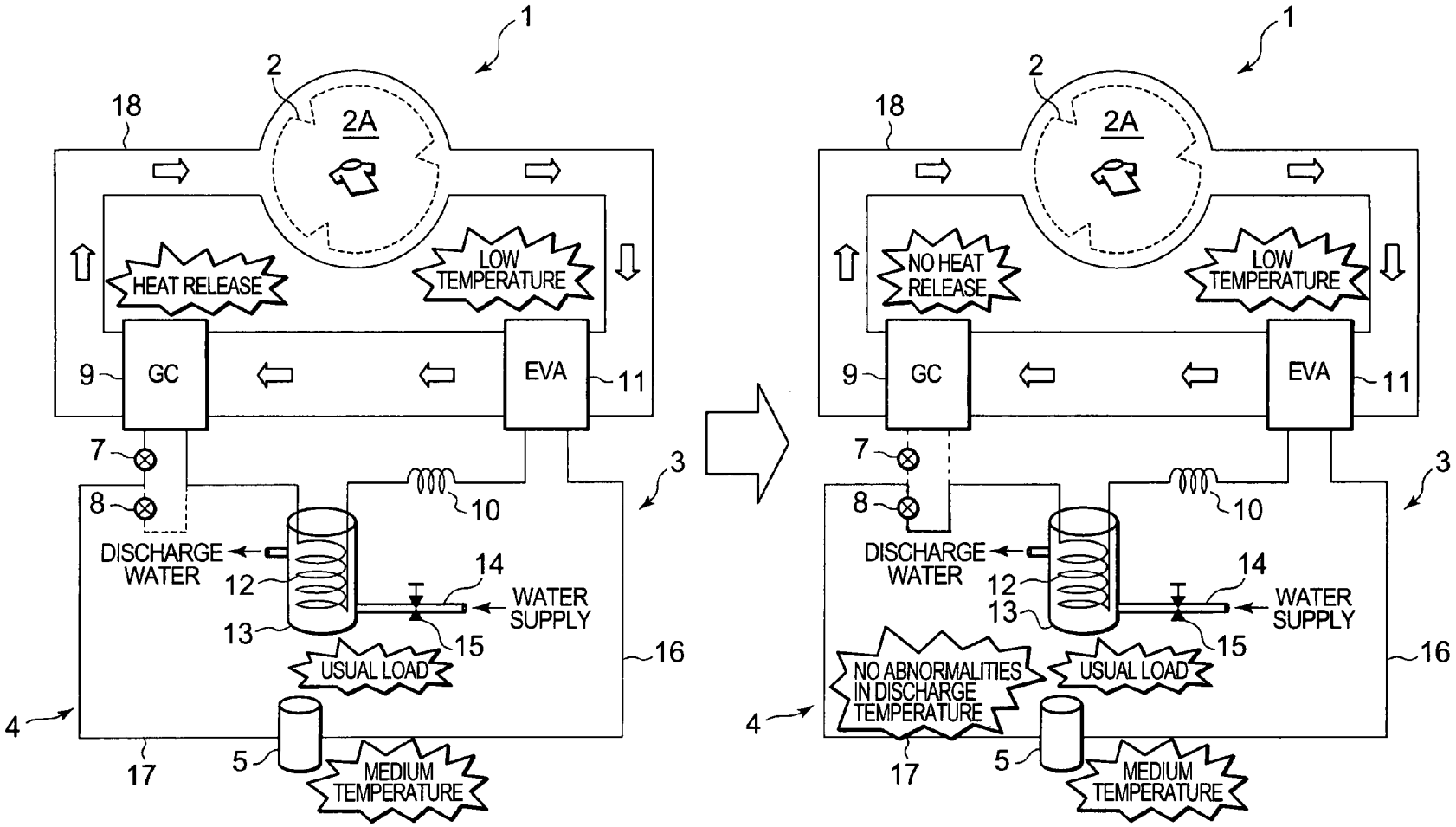
FIG. 8 is a schematic constitution diagram of the dry cleaner showing states in a pre-cooling mode and a cool-down mode.

Moreover, when the compressor 5 of the refrigerant circuit 4 is operated, the high-temperature high-pressure carbon dioxide refrigerant compressed into the supercritical state is discharged to the refrigerant discharge tube 17 from the compressor 5 on the discharge side as shown on a left side of FIG. 8, and flows into the piping 12 via the electromagnetic valve 7 and the gas cooler 9. The refrigerant is cooled by the air circulated in the air circulation path 18 while passing through the gas cooler 9. The refrigerant is further cooled by the city water distributed in the water-cooling heat exchanger 13 while passing through the piping 12, discards waste heat, flows into the capillary tube 10 while keeping in the supercritical state, and is liquefied in a pressure reducing process.

At this point, since the passed water amount of the water-cooling heat exchanger 13 is increased to the maximum in the pre-cooling mode, the heat confined in the heat pump device 3 can be efficiently discarded.

Next, the refrigerant flows into the evaporator 11, and absorbs the heat from the air in the air circulation path 18 passed through the evaporator 11 to thereby cool the air. Thereafter, the refrigerant is sucked into the compressor 5 on the suction side.

Moreover, the control device 20 monitors one of the temperature of the refrigerant circuit 4 and the temperature of the air circulation path 18, and shifts from the pre-cooling mode to the cooling-down mode when the above temperature has become a predetermined temperature or more. It is to be noted that the shift from the pre-cooling mode to the cooling-down mode may be performed by the time program.

In this cooling-down mode, the controller 20 continuously operates the fan, closes the electromagnetic valve 7 of the refrigerant circuit 4, and opens the electromagnetic valve 8. Moreover, the water amount adjustment valve 15 is fully opened continuously from the pre-cooling mode to pass the water from the city water piping 14 to the water-cooling heat exchangers 13.

Moreover, when the compressor 5 of the refrigerant circuit 4 is operated, the high-temperature high-pressure carbon dioxide refrigerant compressed into the supercritical state is discharged to the refrigerant discharge tube 17 from the compressor 5 on the discharge side as shown on a right side of FIG. 8, and flows into the piping 12 via the electromagnetic valve 8. The refrigerant is cooled by the city water distributed in the water-cooling heat exchanger 13 while passing through the piping 12, discards waste heat, flows into the capillary tube 10 while keeping in the supercritical state, and is liquefied in a pressure reducing process. When the refrigerant is cooled by the water-cooling heat exchanger 13 in this manner, the heat confined in the heat pump device 3 is discarded, and an air cooling capacity can be enhanced.

Next, the refrigerant flows into the evaporator 11, and absorbs the heat from the air in the air circulation path 18 passed through the evaporator 11 to thereby cool the air. Thereafter, the refrigerant is sucked into the compressor 5 on the suction side. The control device 20 brings the compressor 5 into the maximum frequency within the limits of the discharged refrigerant pressure and the case temperature. Moreover, the open degree of the water amount adjustment valve 15 is controlled to bring the inlet refrigerant temperature of the evaporator 11 to a predetermined temperature.

The air circulated in the air circulation path 18 exchanges the heat with the evaporator 11, and is cooled. On the other hand, since any refrigerant does not flow through the gas cooler 9, a heating capacity is eliminated. Accordingly, the temperature of the air circulated in the air circulation path 18 drops, and the temperature of the clothing in the drum 2 is lowered. Moreover, after executing the cooling-down mode by the program for the predetermined time, the control device 20 stops the operation.

Figure 10:
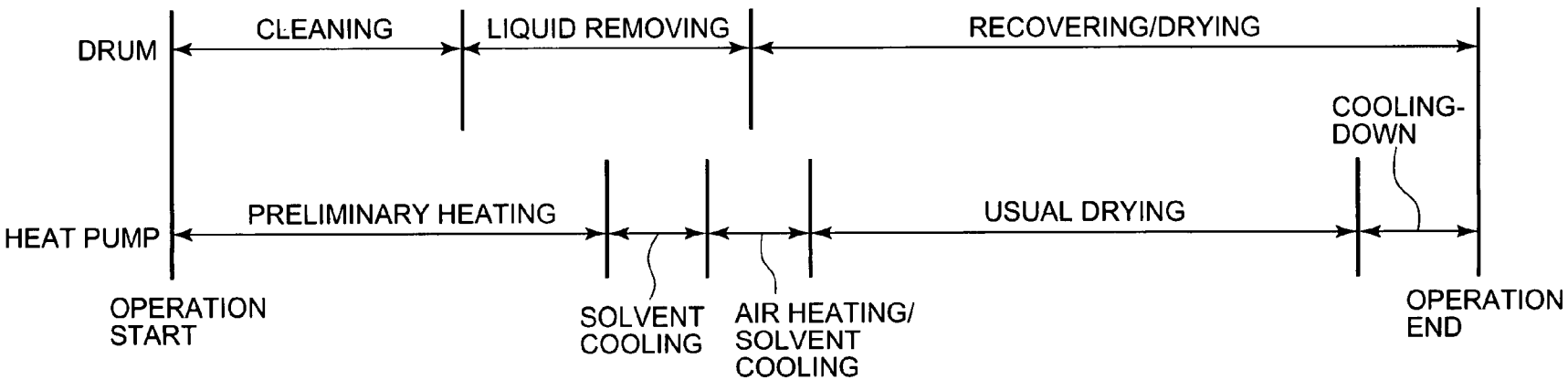
FIG. 10 is a diagram to explain an operation process of a conventional dry cleaner.
Figure 11:
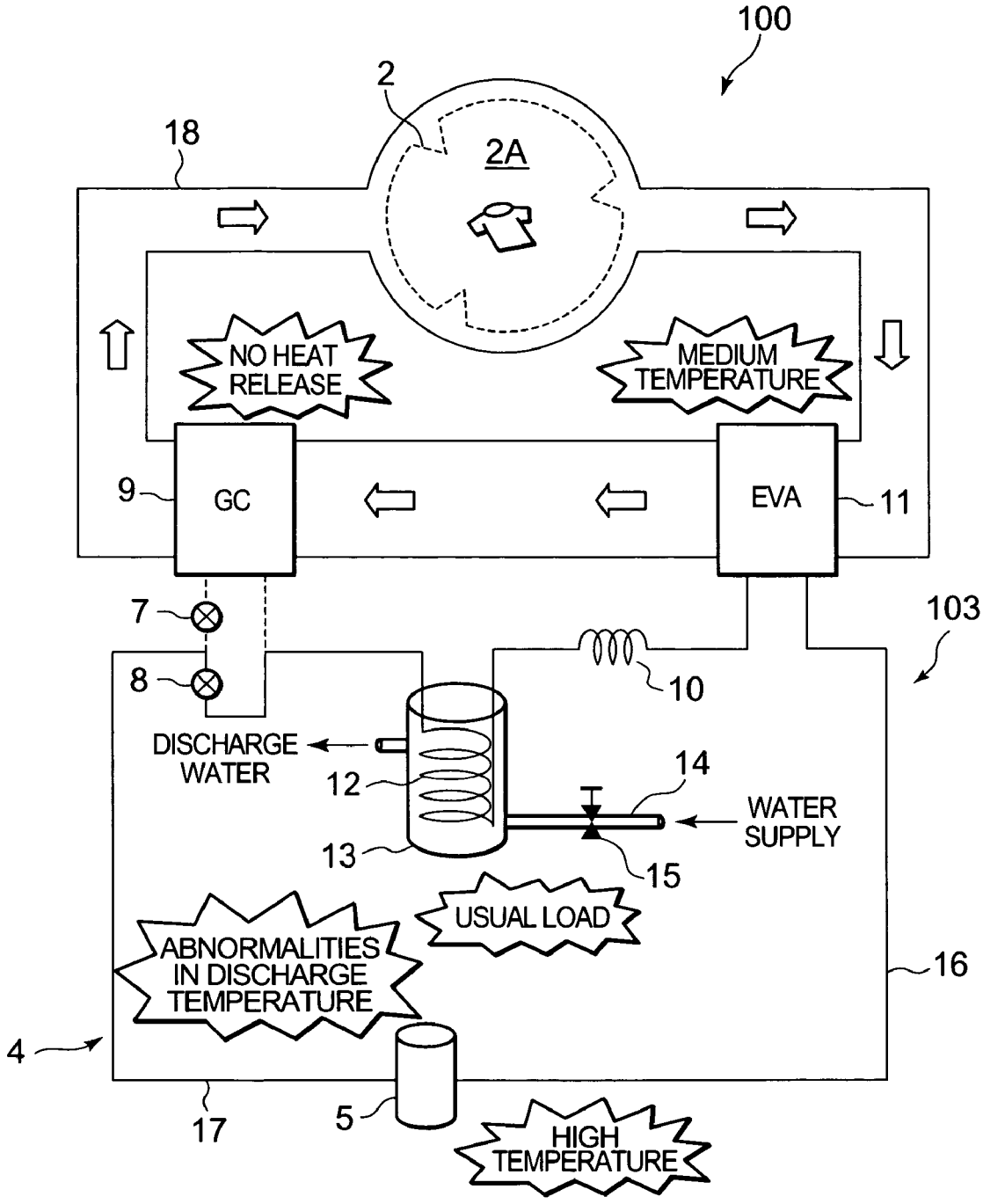
FIG. 11 is a schematic constitution diagram of the dry cleaner showing a state in a conventional cool-down mode.

On the contrary, in a heat pump device 103 of a conventional dry cleaner 100, the refrigerant radiates the heat in the gas cooler 9 in the drying mode as shown in FIGS. 10 and 11, and the refrigerant then radiates further extra waste heat in the water-cooling heat exchanger 13, and the electromagnetic valve 7 which has been opened is closed and the electromagnetic valve 8 which has been closed is opened when the shit is made to the cooling-down mode, so that the refrigerant only radiates the heat in the water-cooling heat exchanger 13.

Figure 12:
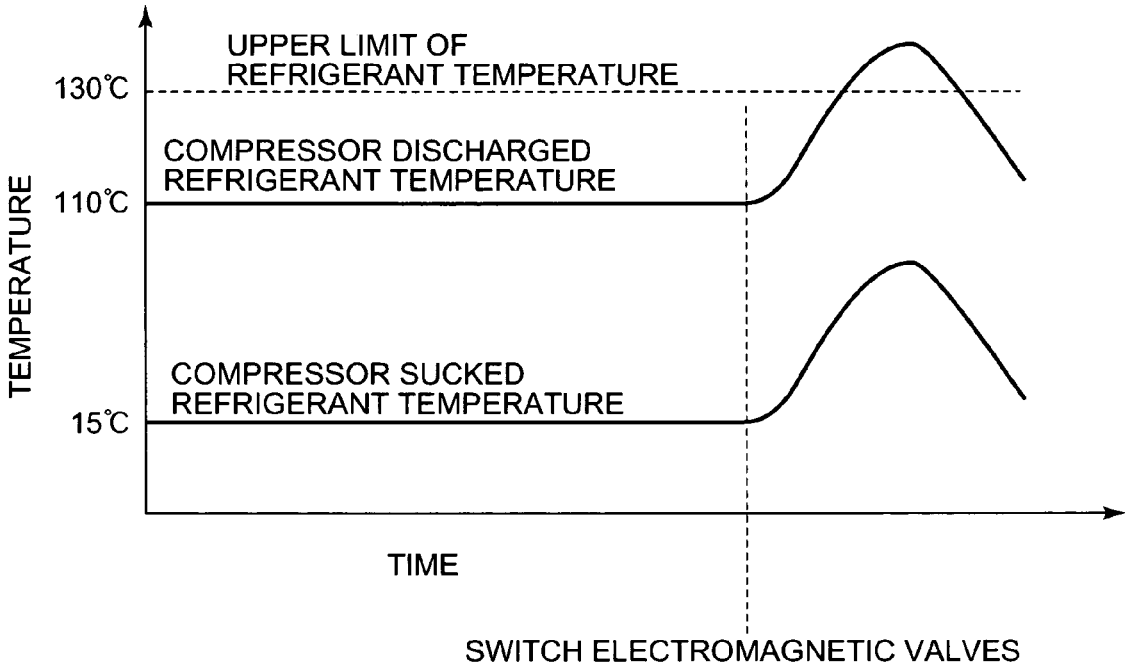
FIG. 12 is diagram showing changes in the compressor discharge refrigerant temperature and a compressor sucked refrigerant temperature during a mode transition of FIG. 11.

Thus, even if the amount of water passed to the water-cooling heat exchanger 13 is increased by the water amount adjustment valve 15 immediately after the mode has been changed, a temporary insufficiency of discharged heat amount is caused while the passed water amount is being increased. As a consequence, the temperature of the evaporator 11 rises, and a sucked gas temperature of the compressor 5 rises, which leads to an increase in the case temperature of the compressor 5 and an increase in the discharged refrigerant temperature of the compressor 5. The increase in the passed water amount caused by the water amount adjustment valve 15 advances heat discharge processing, so that the temperatures of the respective parts drop and the temperature of the clothing also drops to a temperature at which it can be taken out. However, while the temporary insufficiency of discharged heat amount is being caused, the discharged refrigerant temperature of the compressor 5 exceeds a permissible temperature, for example, +130° C. as shown in FIG. 12, which has caused a problem that a life of heat pump device 103 is shortened.

Figure 9:
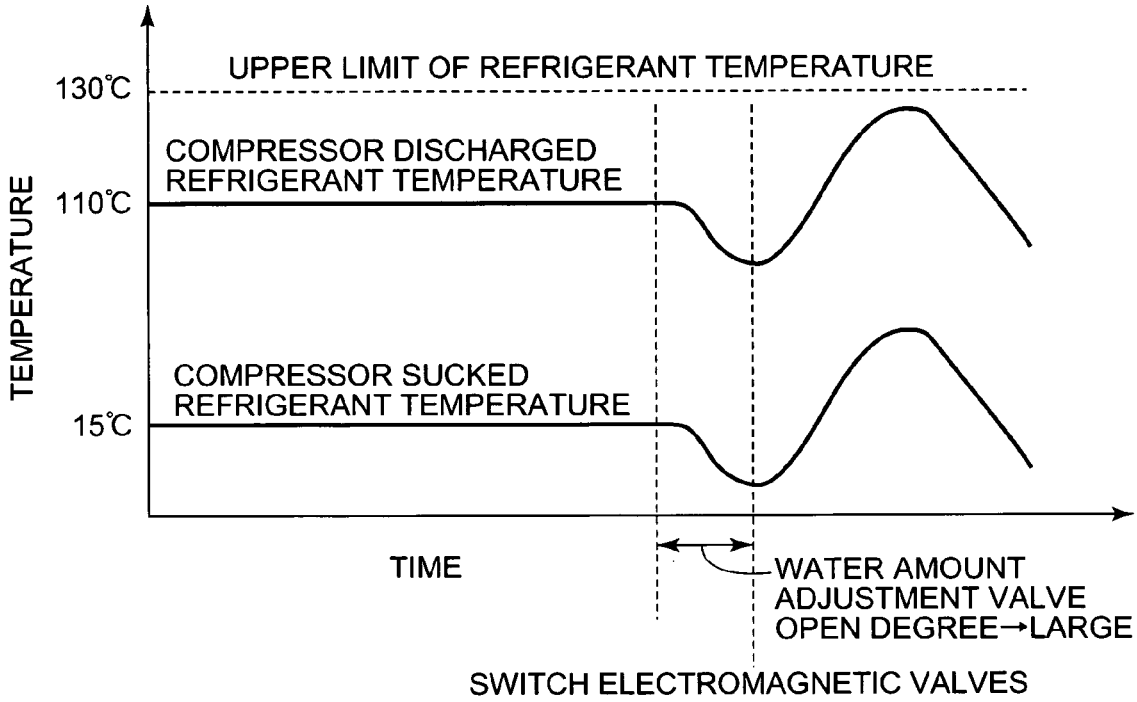
FIG. 9 is a diagram showing changes in a compressor discharged refrigerant temperature and a compressor sucked refrigerant temperature during a mode transition from the drying mode to the cool-down mode.

However, in the present embodiment, the shift is made from the drying mode to the cooling-down mode via the pre-cooling mode without shifting from the drying mode directly to the cooling-down mode, as described above. Thus, the discharged heat amount in the water-cooling heat exchanger of the compressor 5 is once increased in the pre-cooling mode to lower the discharged refrigerant temperature of the compressor 5 and the sucked refrigerant temperature of the compressor 5 as shown in FIG. 9, and it is therefore possible to prevent a conventional disadvantage that the discharged refrigerant temperature of the compressor 5 abnormally rises due to the insufficiency of discharged heat amount immediately after the start of the cooling-down mode. This allows a prolonged life of equipment constituting the heat pump device 3, and can eliminate a disadvantage that the compressor 5 is brought to a high temperature to stop protection.

It is to be noted that in the present embodiment, the discharged heat amount in the water-cooling heat exchanger is increased in the pre-cooling mode immediately before the end of the drying mode to prevent the abnormal temperature increase of the compressor 5 in the cooling-down mode. However, in addition to this, the abnormal temperature increase of the compressor 5 in the cooling-down mode may be prevented by means for changing volumes of refrigerants flowing to the electromagnetic valves 7, 8 comprising, for example, a refrigerant flow volume adjustment valve and a bypass valve of the gas cooler, in the pre-cooling mode immediately before the end of the drying mode.

It is to be noted that in the present embodiment, the water amount adjustment valve 15 is used as means for controlling the discharged heat amount to control the amount of water passed to the water-cooling heat exchanger 13, but in addition to this, an air blower or the like may be used as the discharged heat amount controlling means to control an amount of air used for air cooling. Thus, the heat from the refrigerant can be effectively removed, and the delicate drying can be effectively achieved as described above. Further, the water amount and the air amount can be adjusted to easily and accurately control the discharged heat amount.

Moreover, silicon is used as the washing liquid (solvent) in the embodiment, but the present invention is not limited thereto, and the present invention is also effective even in a case where a conventional petroleum-based solvent is used.

Furthermore, the dry cleaner is taken as an example which is provided with an unshown washing liquid circulation path in the present embodiment, but the present invention is not limited thereto, and the present invention is also effective even in a case of a drying machine using conventional heat pump device.

Still further, in the present embodiment, carbon dioxide is used as the refrigerant in the refrigerant circuit constituting the heat pump device 3, but other refrigerants are also applicable.

What is claimed is:

1. A drying machine equipped with a storage chamber to store a matter to be dried, and a heat pump in which a refrigerant circuit is constituted of a compressor, a radiator, expansion means and an evaporator, a refrigerant discharged from the compressor being passed through the radiator, the expansion means and the evaporator, and air being circulated from the radiator to the evaporator through the storage chamber, whereby the matter to be dried is dried in the storage chamber, the drying machine comprising:

heat discharge means for removing heat from the refrigerant which enters the expansion means; and control means for variably controlling a discharged heat amount in the heat discharge means and capacity of the compressor, wherein the control means has at least two kinds of drying modes including a usual drying mode and a delicate drying mode, and in the delicate drying mode, a temperature of the air discharged into the storage chamber is set lower than in the usual drying mode to control the capacity of the compressor and to increase the discharged heat amount in the heat discharge means.

2. A drying machine equipped with a storage chamber to store a matter to be dried, and a heat pump in which a refrigerant circuit is constituted of a compressor, a radiator, expansion means and an evaporator, a refrigerant discharged from the compressor being passed through the radiator, the expansion means and the evaporator, air being circulated from the radiator to the evaporator through the storage chamber, whereby the matter to be dried is dried in the storage chamber, the drying machine comprising:

heat discharge means for removing heat from the refrigerant which enters the expansion means; and control means for variably controlling a discharged heat amount in the heat discharge means and a restriction amount in the expansion means, wherein the control means has at least two kinds of drying modes including a usual drying mode and a delicate drying mode, and in the delicate drying mode, a temperature of the air discharged into the storage chamber is set lower than in the usual drying mode to control the restriction amount in the expansion means and to increase the discharged heat amount in the heat discharge means.

3. The drying machine according to claim 1 or 2, wherein the heat discharge means water-cools or air-cools the refrigerant which enters the expansion means, and the control means controls an amount of cooling water used for water-cooling or an amount of air used for air-cooling to control the discharged heat amount in the heat discharge means.

4. The drying machine according to claim 1 or 2, wherein the control means controls the discharged heat amount in the heat discharge means so as to maintain the temperature of the air passed through the evaporator at a prescribed value.

5. The drying machine according to claim 1 or 2, wherein the control means executes a cooling-down mode in which the refrigerant discharged from the compressor is not passed to the radiator but is passed to the heat discharge means, the expansion means and the evaporator after termination of the drying mode in order to lower the temperature of the air discharged into the storage chamber, and the control means increases the discharged heat amount in the heat discharge means before the termination of the drying mode.

6. The drying machine according to claim 3, wherein the control means controls the discharged heat amount in the heat discharge means so as to maintain the temperature of the air passed through the evaporator at a prescribed value.

7. The drying machine according to claim 3, wherein the control means executes a cooling-down mode in which the refrigerant discharged from the compressor is not passed to the radiator but is passed to the heat discharge means, the expansion means and the evaporator after termination of the drying mode in order to lower the temperature of the air discharged into the storage chamber, and the control means increases the discharged heat amount in the heat discharge means before the termination of the drying mode.

8. The drying machine according to claim 4, wherein the control means executes a cooling-down mode in which the refrigerant discharged from the compressor is not passed to the radiator but is passed to the heat discharge means, the expansion means and the evaporator after termination of the drying mode in order to lower the temperature of the air discharged into the storage chamber, and the control means increases the discharged heat amount in the heat discharge means before the termination of the drying mode.

* * * * *